US008317467B2

(12) United States Patent
Dalsania et al.

(10) Patent No.: US 8,317,467 B2
(45) Date of Patent: Nov. 27, 2012

(54) RADIAL CHANNEL DIFFUSER FOR STEAM TURBINE EXHAUST HOOD

(75) Inventors: Prakash B. Dalsania, Bangalore (IN); Joshy John, Bangalore (IN)

(73) Assignee: General Electric Company, Schenectady, NY (US)

( * ) Notice: Subject to any disclaimer, the term of this patent is extended or adjusted under 35 U.S.C. 154(b) by 564 days.

(21) Appl. No.: 12/648,721

(22) Filed: Dec. 29, 2009

(65) Prior Publication Data

US 2011/0158799 A1 Jun. 30, 2011

(51) Int. Cl.
*F01D 25/30* (2006.01)

(52) U.S. Cl. ..... 415/207; 415/224.5; 415/225

(58) Field of Classification Search ..... 415/914, 415/211.3, 220, 213.1, 207, 176–178, 224.5, 415/225, 226; 60/690, 692, 694, 697
See application file for complete search history.

(56) References Cited

U.S. PATENT DOCUMENTS

| | | | | |
|---|---|---|---|---|
| 3,552,877 | A | 1/1971 | Christ et al. | |
| 4,013,378 | A | 3/1977 | Herzog | |
| 4,326,832 | A * | 4/1982 | Ikeda et al. | 415/213.1 |
| 5,257,906 | A | 11/1993 | Gray et al. | |
| 5,518,366 | A * | 5/1996 | Gray | 415/226 |
| 6,419,448 | B1 | 7/2002 | Owczarek | |
| 7,934,904 | B2 * | 5/2011 | Demiraydin et al. | 415/207 |
| 8,240,152 | B2 * | 8/2012 | Dinu | 60/773 |

FOREIGN PATENT DOCUMENTS

EP 1707762 A2 10/2006

* cited by examiner

*Primary Examiner* — Igor Kershteyn
(74) *Attorney, Agent, or Firm* — Ernest G. Cusick; Frank A. Landgraff

(57) ABSTRACT

An exhaust hood for an axial steam turbine that includes a radial channel, downstream from the normal flow pattern. The radial channel guides the exhaust steam flow in upper half of the hood in the flow momentum direction. Due to this pattern of flow direction, vortex generation in upper exhaust hood is reduced and increased flow diffusion results. The geometric arrangement can eliminate the outer casing of the exhaust hood over the axial length of the turbine inner casing, allowing the turbine inner casing to be supported directly by a foundation for the steam turbine.

20 Claims, 7 Drawing Sheets

RADIAL CHANNEL DIFFUSER FOR STEAM TURBINE EXHAUST HOOD

BACKGROUND OF THE INVENTION

The invention relates generally to steam turbines and more specifically to exhaust hoods for efficiently diffusing steam to a condenser.

In the discharge of exhaust steam from an axial flow turbine, for example discharge of this exhaust steam to a condenser, it is desirable to provide as smooth a flow of steam as possible and to minimize energy losses from accumulation of vortices, turbulences and non-uniformity in such flow. Usually the exhaust from the turbine is directed into an exhaust hood and from there through a discharge opening in the hood in a direction essentially normal to the axis of the turbine into a condenser. It is desirable to achieve a smooth transition from axial flow at the exhaust of the turbine to radial flow in the exhaust hood and thence a smooth flow at the discharge opening of this hood into the condenser.

In the constructing of an effective exhaust hood for use with such an axial flow turbine it is desirable to avoid acceleration losses within any guide means employed therein and to achieve a relatively uniform flow distribution at the discharge opening of the exhaust hood for the most efficient conversion of energy in the turbine and effective supplying of exhaust steam to the condenser to which it is connected.

It is also desirable to achieve optimum efficiency at the last stage buckets of the turbine prior to exhaust from the turbine by achieving a relatively uniform circumferential and radial pressure distribution in the exit plane of the last stage buckets. Usually, attempts have been made to accomplish these results while employing a hood having as short an axial length as possible, so as to limit the axial size of the turbine train.

The prior art has employed, in the exhaust duct connected to the turbine, vanes, which have smoothly curved surfaces for effectively changing the axial flow of the steam from the turbine to the generally radial flow. For example of such an arrangement for converting the axial flow of the exhaust from the turbine to radial flow is shown in U.S. Pat. No. 3,552,877 by Christ et al. Further developments in prior art exhaust hoods for axial flow turbines, such as U.S. Pat. No. 4,013,378 by Herzog, have incorporated multiple sets of vanes for further smoothing flow. The exhaust hood includes a first set of guide vanes arranged in an exhaust duct connected to the turbine adjacent the last stage buckets thereof. These vanes are curved to provide a relatively smooth transition of steam flow from an axial direction to a generally radial direction. A guide ring circumferentially surrounds the first set of guide vanes and a plurality of secondary vanes are circumferentially spaced around this guide ring. Steam, which is discharged radially from the first set of vanes to the secondary vanes, is directed by the secondary vanes to the discharge opening of the exhaust hood. The secondary vanes are substantially equally spaced around the guide ring and are curved, at different angles to effect different angles of discharge of steam from these vanes. The angles of discharge are chosen so as to direct the steam toward the discharge opening of the exhaust hood in a manner achieving substantially uniform flow distribution across the exit plane of the last stage buckets and across the plane of the discharge opening. However, while such vanes may be optimized for one set of flow conditions, they may operate with significantly less effectiveness at other flows.

Diffusers, for example, are commonly employed in steam turbines. Effective diffusers can improve turbine efficiency and output. Unfortunately, the complicated flow patterns existing in such turbines as well as the design problems caused by space limitations make fully effective diffusers almost impossible to design. A frequent result is flow separation that fully or partially destroys the ability of the diffuser to raise the static pressure as the steam velocity is reduced by increasing the flow area. For downward exhaust hoods used with axial steam turbines, the loss from the diffuser discharge to the exhaust hood discharge varies from top to bottom. At the top, much of the flow must be turned 180 degrees to place it over the diffuser and inner casing, then turned downward. Pressure at the top is thus higher than at the sides, which are in turn higher than at the bottom.

FIG. 1 illustrates a perspective partial cutaway of a double flow steam turbine a portion of a steam turbine. The steam turbine, generally designated 10, includes a rotor 12 mounting a plurality of turbine buckets 14. An inner turbine casing 16 is also illustrated mounting a plurality of diaphragms 18. A centrally disposed generally radial steam inlet 20 applies steam to each of the turbine buckets and stator blades on opposite axial sides of the turbine to drive the rotor. The stator vanes of the diaphragms 18 and the axially adjacent buckets 14 form the various stages of the turbine forming a flow path and it will be appreciated that the steam is exhausted from the final stage of the turbine for flow into a condenser beneath (not shown).

Also illustrated is an outer exhaust hood 21, which surrounds and supports the inner casing of the turbine as well as other parts such as the bearings. The turbine includes steam guides (not shown) for guiding the steam exhausting from the turbine into an outlet 26 for flow to one or more condensers. With the use of an exhaust hood supporting the turbine, bearings and ancillary parts, the exhaust steam path is tortuous and subject to pressure losses with consequent reduction in performance and efficiency. A plurality of support structures may be provided within the exhaust hood. 21 to brace the exhaust hood and to assist in guiding the steam exhaust flow. An exemplary support structure 30 is situated to receive and direct the steam exhaust flow 35 from the steam turbine 10. The diffusion of the steam is restricted to the volume in the exhaust hood 21.

The exhaust hood 21 includes an upper hood 22 and a lower hood 23. The upper and lower hoods are joined along a horizontal seating surface 33. An upper part of the lower hood 23 is reinforced with support members 34 providing a support frame 36. The weight borne by the support frame 36 is transferred at support ledge 27 to a foundation 40.

FIG. 2 illustrates a schematic elevation view of a prior an exhaust hood for the double flow steam turbine 10 including an exhaust flow path 35. The steam turbine LP section consists of an inlet domain 20, turbine stages (nozzles 18 and buckets 14) and an exhaust hood 22 with diffuser 25. One of the main functions of the exhaust hood is to recover the static pressure and guide the exhaust steam flow 35 from last stage buckets 15 to the condenser steam outlet 26 to the condenser (not shown) underneath. The exhaust hood 21 includes the upper exhaust hood 22 and the lower exhaust hood 23. Flow from the last stage buckets 15, which could have very high swirl and high flow gradient in radial direction, enters the condenser through exhaust hood 21. Part of the flow 28 directly flows down to condenser through the lower exhaust hood 23 and the remaining flow 29 travels through upper exhaust hood 22. The flow in the upper exhaust hood 22 is directed by flow guide 32 and begins to turn 180 degrees from a vertically upward direction to downward direction over the inner casing 16 to reach the condenser. This results in strong vortex formation 38 behind the steam guide 24 in upper exhaust hood and minimizes the effective flow area between the steam guide and outer wall of the hood, thereby increasing losses in the steam path as well. This phenomena decreases the flow diffusion in upper half of exhaust hood, results in degradation of exhaust hood performance, which has direct impact on the last stage bucket performance.

Accordingly, it would be desirable to eliminate vortex flow in the upper exhaust hood and provide improved flow patterns and diffusion performance, particularly in the upper exhaust hood.

BRIEF DESCRIPTION OF THE INVENTION

The present invention relates to an exhaust arrangement for an axial flow steam turbine in which a radial channel to the turbine condenser partially eliminates vortices in the upper exhaust hood and improves hood performance.

Briefly in accordance with one aspect of the present invention, an exhaust arrangement is provided for an axial flow steam turbine. The exhaust arrangement includes an inner turbine casing with a plurality of turbine stages providing an axial steam flow path through the inner turbine casing and an exhaust outlet from a plurality of buckets of a last turbine stage. A turbine condenser is mounted below the steam turbine. An exhaust hood is provided at a downstream end of the steam turbine where the exhaust outlet flows through a diffuser into a dual path to the turbine condenser. A bearing cone and a plurality of annular steam guides define a diffuser flow path for the exhaust outlet flow. A first exhaust path of the dual path extends through a lower section of the diffuser to a lower section of the exhaust hood and then essentially downward to the condenser. An upper section of the exhaust hood is in fluid communication with an upper section of the diffuser. A downstream radial channel of the exhaust hood is in fluid communication with the upper section of the exhaust hood and is further in fluid communication with the turbine condenser below. A second exhaust path of the dual path flows through the upper section of the diffuser into the upper section of the exhaust hood, downstream axially to the radial channel and then downward through the radial channel to the turbine condenser.

According to another aspect of the present invention, an axial flow steam turbine is provided. The steam turbine includes an inner casing with a plurality of turbine stages providing an axial steam flow path through the inner casing and an exhaust outlet from a plurality of buckets of the last turbine stage. A turbine condenser is mounted below the steam turbine. A foundation is provided for the steam turbine. An exhaust hood at a downstream end of the steam turbine includes at least one exhaust path through a radial channel of a dual exhaust path from the exhaust outlet of the inner turbine casing to the turbine condenser. The exhaust hood is mounted to the inner turbine casing at an axial end of the inner casing. Support means are provided for the steam turbine such that the inner casing is supported directly from the foundation.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including improving static pressure recovery in a low pressure (LP) exhaust hood and thereby improving the heat rate or output of the steam turbine. Further, a very simple geometry construction results from the invention, thereby helping, to reduce weight by eliminating a portion of the outer casing of the exhaust hood that covers the inner casing, thereby saving cost.

A further advantage of the geometrical construction for the hood provides an opportunity to rest the inner turbine casing on the foundation for the turbine, which lead to enhanced machine reliability.

Figure 1:
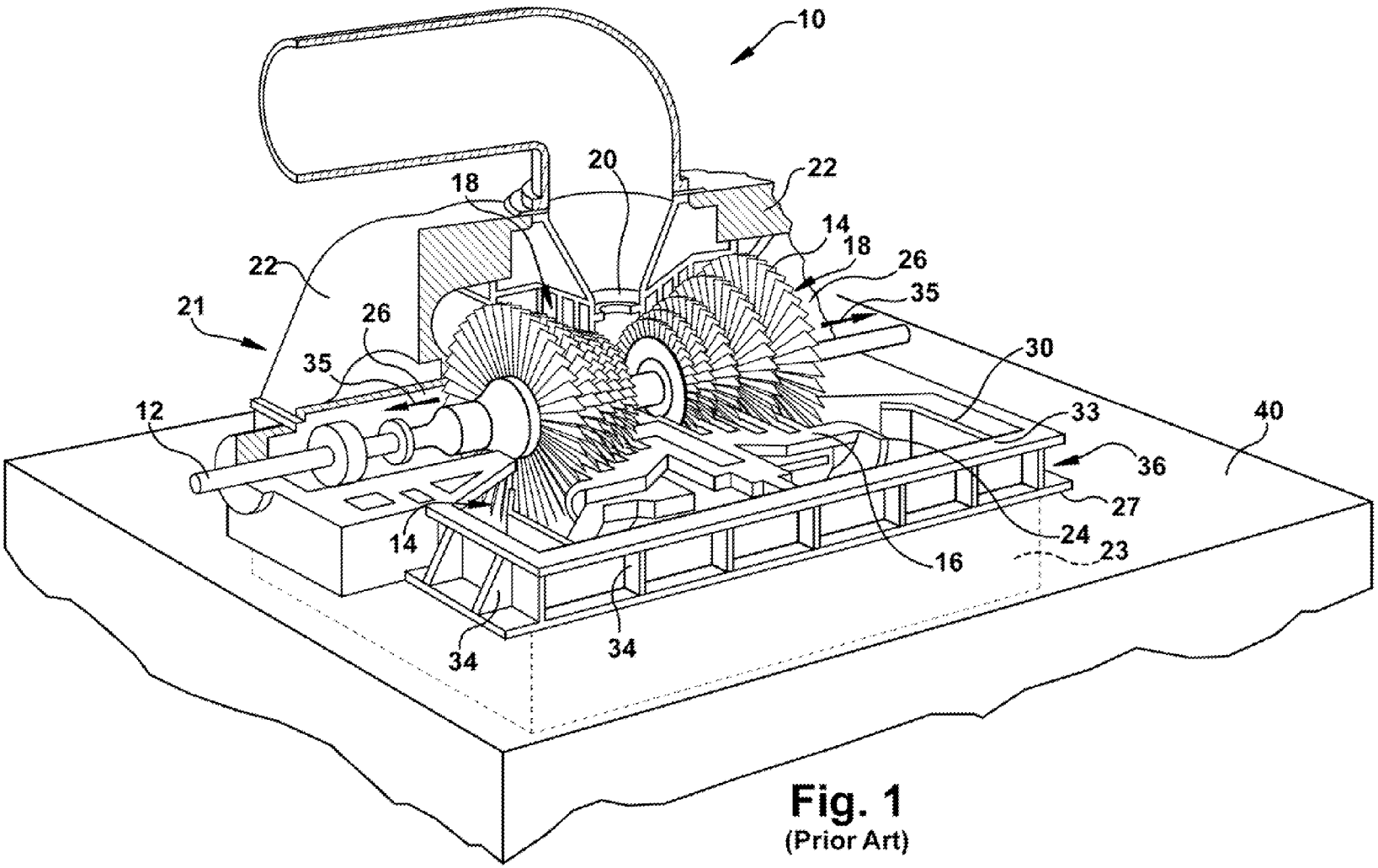
Fig. 1 (Prior Art)
FIG. 1 illustrates a perspective partial cutaway of a double flow steam turbine including a prior art exhaust hood.
Figure 2:
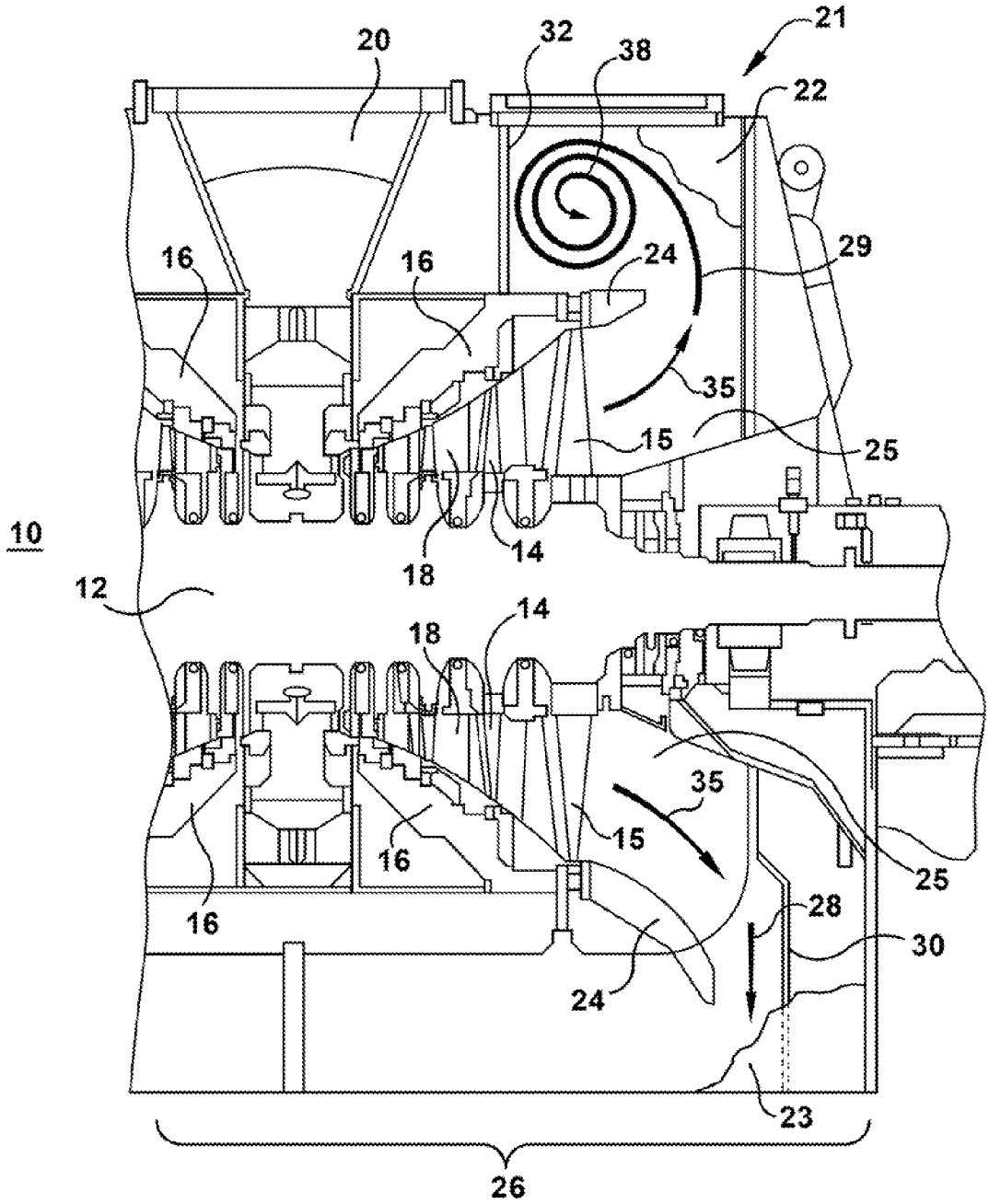
Fig. 2 (Prior Art)
FIG. 2 illustrates a schematic elevation view of a prior art exhaust hood for the double flow steam turbine including an exhaust flow path.
Figure 3:
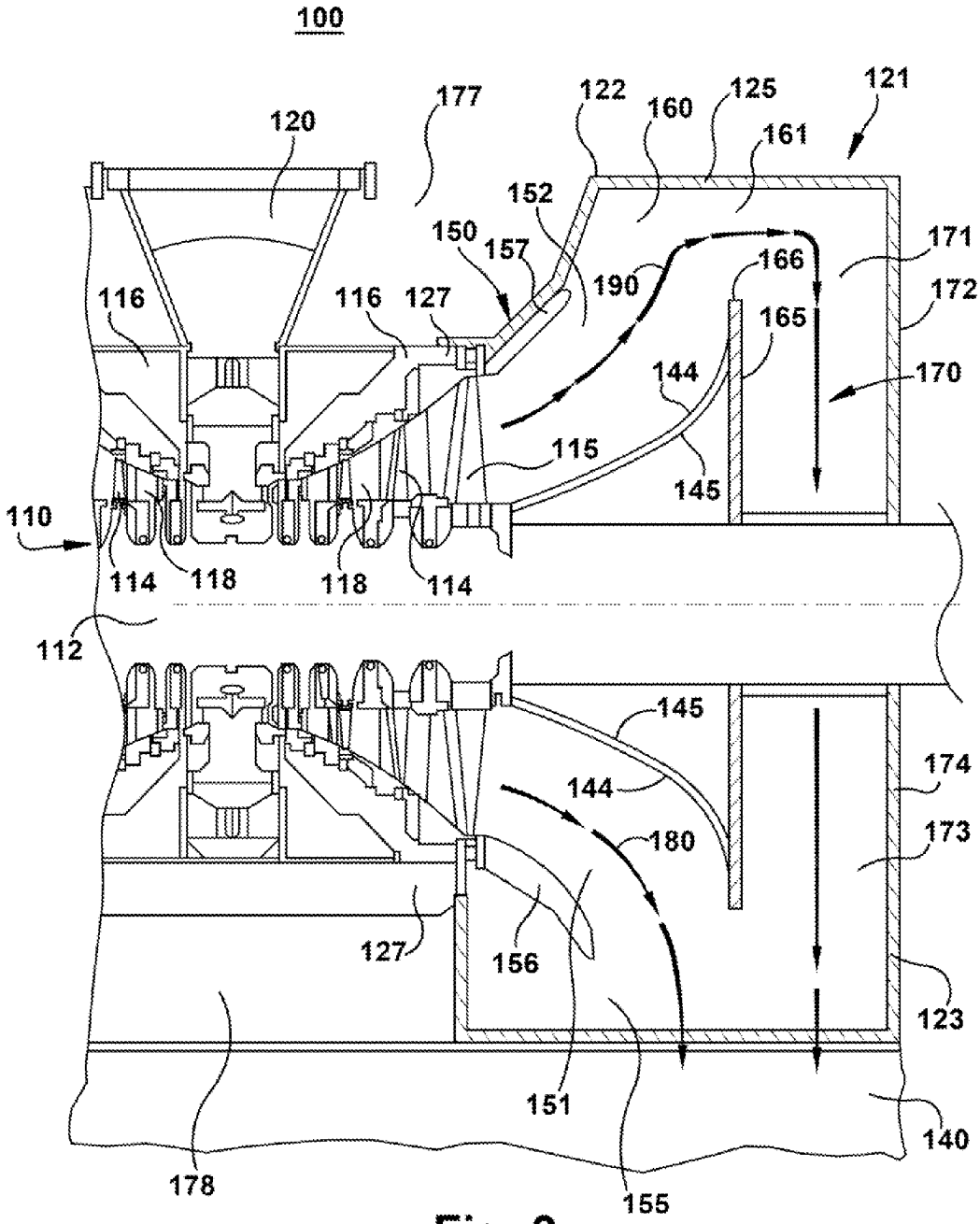
FIG. 3 illustrates a schematic elevation view of a first embodiment of the inventive exhaust arrangement for an axial flow steam turbine.

The present invention incorporates a concept of a radial channel, which guides the flow in upper half of the hood in the flow momentum direction. Due to this pattern of flow direction, the vortex generation in upper exhaust hood may be reduced and hence an increase in flow diffusion would result. The radial channel may be disposed behind the end wall of the exhaust diffuser to direct the flow from upper half of exhaust hood towards a turbine condenser as shown in FIG. 3. This radial channel configuration will help to minimize the vortex generation in upper half of the hood. Since there is no inner casing in radial channel there will be smooth transition of flow over 180 degrees to the turbine condenser, which will improve the flow diffusion, and hence provide low pressure section efficiency improvement. Also, better diffusion of flow in upper section of the exhaust hood helps to achieve uniform pressure gradient between the last stage bucket (LSB) exits and the exhaust inlet, which has a favorable impact on LSB performance.

A first embodiment of the present invention provides an exhaust arrangement 121 for an axial flow steam turbine as illustrated in FIG. 3. An inner turbine casing 116 includes one or more turbine stages of nozzles 114 and buckets 118 providing an axial steam flow path through the inner turbine casing 116. An exhaust outlet flows from multiple last stage buckets 115. An exhaust hood 125 is coupled to a downstream axial end 127 of the inner turbine casing 116. A turbine condenser 140 is mounted below the exhaust hood 125 for condensing and subcooling the exhausted steam. For a dual axial steam turbine, an exhaust hood 125 is coupled at each downstream axial end 127 of the inner casing 116 with one or more turbine condensers 140 accepting the exhausted steam.

Figure 4:
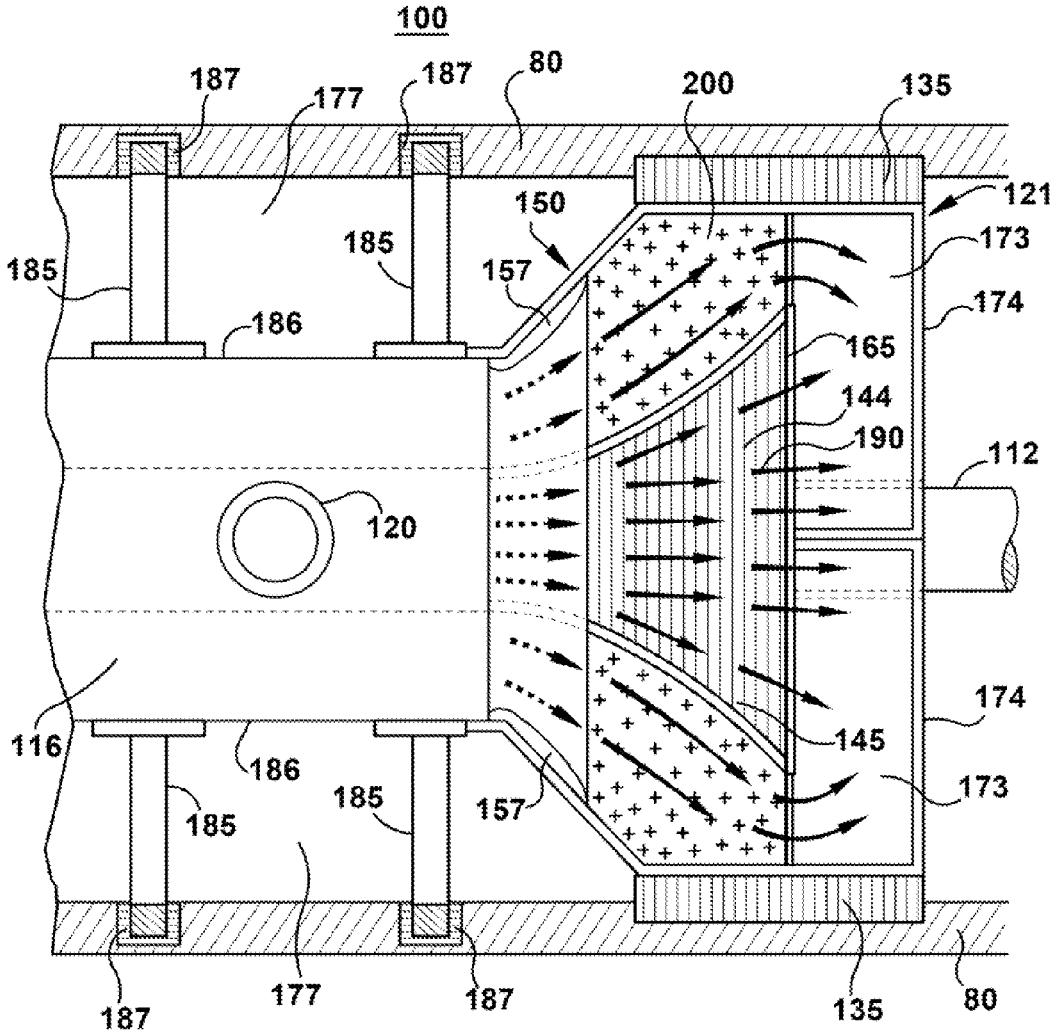
FIG. 4 illustrates a top view of an embodiment of the steam turbine and exhaust arrangement with the upper exhaust hood removed.

The exhaust hood 125 provides a dual exhaust path from the last stage buckets 118 to the turbine condenser 140. The exhaust hood 125 may include an upper exhaust hood 122 and a lower exhaust hood 123 separated conventionally along a horizontal joint 135 (FIG. 4). The exhaust hood 125 includes a diffuser 150, a lower section 155, an upper section 160, and a downstream radial channel 170. A first exhaust path 180 for steam discharging into the exhaust hood 125 from the last stage buckets 118 includes a lower section 151 of the diffuser 150, the lower section 155 of the exhaust hood 125 and a downward discharge into the condenser 140. The second exhaust path 190 flowing from the last stage buckets 118 of the inner casing 116 includes an upper section 152 of the diffuser 150, the upper section 160 of the exhaust hood 125, and a downstream radial channel 170 of the exhaust hood 125 discharging downward to the turbine condenser 140 below.

The diffuser 150 is formed between an inner wall 154 of a hearing cone 155 and steam guides 156, 157. The axial downstream ends of the bearing cones engage with a divider wall separating the upper section of the exhaust hood from the downstream section.

The lower half 151 of the diffuser 150 opens into the lower section 155 of the exhaust hood 125. The lower section 155 of the exhaust hood opens downwardly into the turbine condenser 140. The upper half 152 of the diffuser 150 opens into the upper section 160 of the exhaust hood 125. An opening 161 for steam flow from the axial downstream end 161 of the upper section 160 of the exhaust hood 125 to the downstream radial channel 170 is provided between the upper exhaust hood easing wall 125 and the outer end 166 of the circumferential divider wall 165. The radial channel 170 connects the upper section 160 of the exhaust hood with the turbine condenser 140 below. The radial channel 170 includes an upper space 171 between a plane of the divider wall 165 and an endwall 172. The upper space 171 may be formed as a semi-annulus above the rotor shaft 112.

The radial channel 170 may also include two descending exhaust spaces 173 to the turbine condenser 140. The descending exhaust spaces 173 may be positioned axially downstream from the divider wall 165 and be open radially to the upper section 171 of the radial channel above and to the turbine condenser 140 below. The two descending exhaust spaces 173 together may be formed around the rotor shaft 112, which extends axially through the exhaust arrangement 121 and divider wall 165. The exhaust spaces 173 may lie axially between the divider wall 165 and end wall 174. The two descending exhaust spaces 173 may be generally aligned in parallel for the vertical descent to the turbine condenser 140. The two descending exhaust spaces 173 may be an integral part of the exhaust arrangement 121 or may be enclosed in external ductwork. Each of the descending exhaust spaces 173 may include an inner sidewall 175 (FIG. 6), wherein an opening space 176 is provided there-between. The opening space 176 between the descending exhaust spaces 173 of the radial channel 170 may be sufficiently large to allow personnel access to the bearing cone 145 areas.

Because the exhaust hood 125 mates with an axial end 127 of the turbine inner casing 116, the spaces 177, 178 above and below and around the turbine inner easing are not utilized for the exhaust hood. FIG. 4 provides a top view of the steam turbine 100 with the upper exhaust hood removed. Spaces 177 and 178 are available to mount the turbine inner casing 116 to the foundation directly. At least one support arm 185 from each lateral side 186 of the turbine inner casing 116 may extend to the pads 187 on foundation wall 80. The exhaust hood 125 may include a reinforced section 135 which also seated on the foundation wall 80 to provide support for the exhaust hood.

With the upper exhaust hood 1.22 removed, the tap of steam guide 157 and the top surface of the inner wall 144 of the bearing cone 145 are exposed. A general flow pattern 200 of exhaust along the second exhaust path is illustrated between the upper steam guide 157 and the inner wall 144 of the bearing cone 145, continuing over the inner wall 144, and around and over the divider wall 165.

Figure 5:
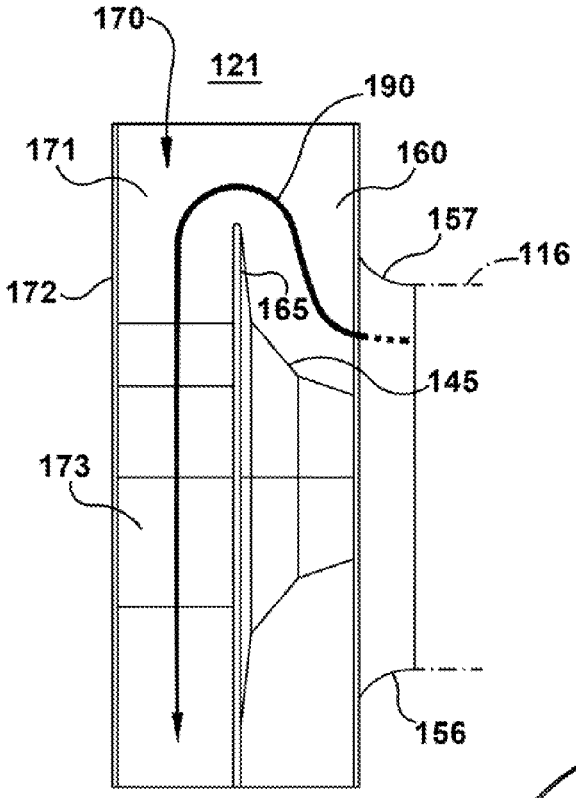
FIG. 5 illustrates a three-dimensional side view of the exhaust arrangement structure with a radial channel.
Figure 6:
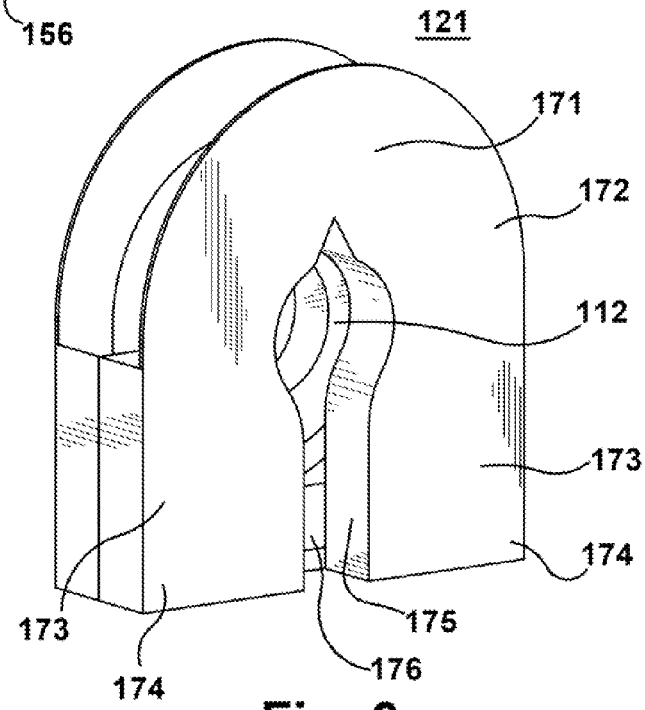
FIG. 6 illustrates a three-dimensional end view of the exhaust arrangement structure with a radial channel.

The radial channel may be formed with different shape and contouring of outer casing as shown in FIGS. 5-6. In a second embodiment of the present invention, the configuration of the radial channel is modified. The two descending exhaust spaces of the radial channel in fluid communication with the upper section of the radial channel and with the turbine condenser may include an exhaust space on each lateral side of the exhaust hood. The descending exhaust space on each respective lateral side may extend radially outboard relative to the exhaust hood in a path to the turbine condenser below. The descending exhaust space may further curve upstream axially such that it descends vertically alongside the outer radial casing of the exhaust hood in a vertical path to the turbine condenser below. Alternatively the vertically descending exhaust space may be enclosed in a separately enclosed volume that exhausts downward to the turbine condenser in a parallel path relative to the condenser flow from the lower section of the exhaust hood.

FIG. 5 illustrates a three-dimensional side view of the exhaust arrangement structure 121 with the external casing of the exhaust hood removed. Steam exhausted from turbine inner casing 116 flows in the second exhaust path 190 between upper steam guide 157 and bearing cone 145 into upper exhaust section of exhaust hood 125. Flow continues over divider wall 165 into the upper section 171 of radial channel 170 between divider wall 165 and end wail 172. Flow continues downward through exhaust section 173 of radial channel 170 on way to condenser (not shown) below.

FIG. 6 illustrates a three-dimensional end view of the exhaust arrangement structure 121 with a radial channel. The radial channel 170 includes an upper section 171 into which exhaust steam flow passing over divider wall 165 (FIGS. 3, 4, 5) enters. Due to endwall 172, the exhaust steam flow is forced downward into two descending exhaust spaces 173 on the way to the condenser below (FIG. 3). The two descending exhaust spaces include an inner radial surface (wall) 175. The two descending exhaust spaces 173 fold around rotor shaft 112 (FIGS. 3, 4) and may allow a space 176 below the rotor shaft for personnel access to the bearing cone area.

Figure 7:
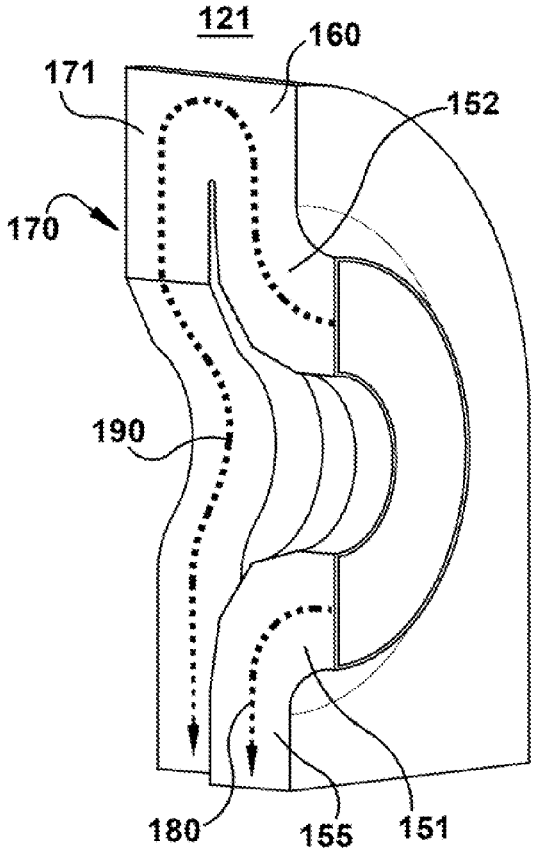
FIG. 7 illustrates an isometric view of one lateral side of the exhaust arrangement viewed from the turbine inner casing end.

FIG. 7 illustrates an isometric three-dimensional sectional view of the exhaust arrangement structure 121 viewed from the turbine inner casing end. Exhaust flow paths are shown as dashed lines within the individual volumes. The first exhaust flow path 180 flows from the diffuser volume between the lower steam guide (not shown) and the bearing cone (not shown) to the lower exhaust volume. The second, exhaust path 190 flows from the diffuser volume between the upper steam guide (not shown) and the bearing cone (not shown) into the upper hood section 160, then into the upper section 171 of the radial channel 170 and then into the descending exhaust section 173 (one shown) on the path to the turbine condenser below (not shown).

Figure 8:
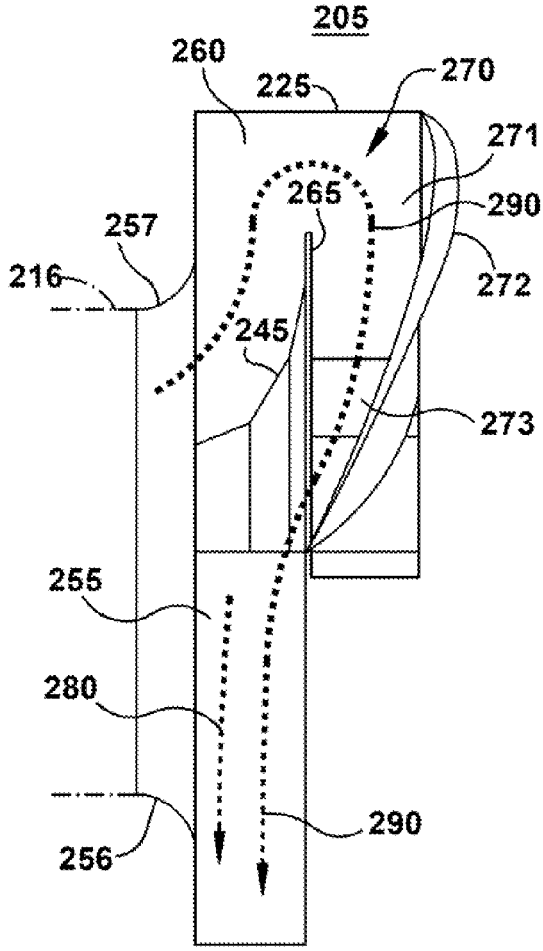
FIG. 8 provides a cutaway side view of the second exhaust path in the second embodiment of the exhaust arrangement.

FIG. 8 provides a cutaway side view of the second exhaust path in the second embodiment of the exhaust arrangement 205. The second exhaust path from the upper half of inner casing outlet 216 flows between the steam guides 257 and an inner wall of the bearing cone 245 into the upper section of the second embodiment of exhaust hood 205. The divider wall 265 extends in a radial direction from the bearing cone 245. The second exhaust flow path 290 passes axially from the upper section 260 of the exhaust hood 205 to the radial channel 270 in the space between the divider wall 265 and the outer casing 225 of the exhaust hood. The second exhaust flow path 210 is forced to turn downward in the upper section 271 of the radial channel 270 by the endwall. A curved descending exhaust space 273 further directs the flow downward, upstream axially, and outboard relative to the exhaust hood outer casing. The second exhaust flow path 290 continues downward to the condenser in a flow parallel to the first exhaust path 280 from the lower section 255 of the exhaust hood.

Figure 9:
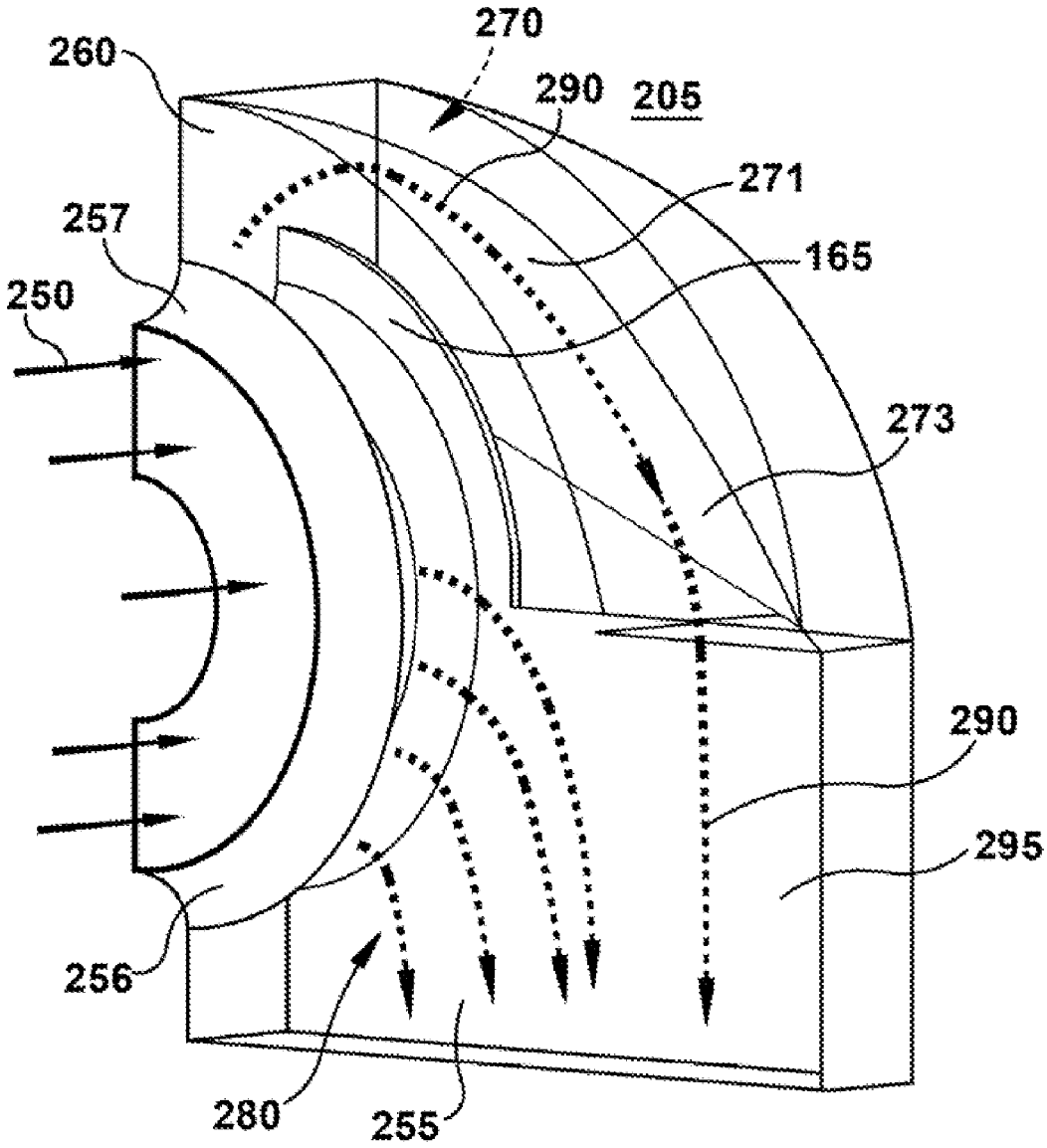
FIG. 9 provides an isometric view of one lateral side of the exhaust arrangement.

FIG. 9 illustrates an isometric view of one lateral side of the exhaust arrangement viewed from the turbine inner casing end. A first exhaust flowpath 280 from the lower half space of inner casing outlet flows between the steam guide 256 and an inner wall of the bearing cone (not shown) into the lower section of the exhaust hood and then downward to the turbine condenser. The second exhaust path 290 from the upper half of inner casing outlet 250 flows between the steam guide 257 and an inner wall of the bearing cone (not shown) into the upper section 260 of the exhaust hood. The second exhaust path 290 from the upper section 160 of the exhaust hood passes over the divider wall 265 into the radial channel 270 of the exhaust hood. The rear wall 272 of the downstream section forces the flow in a downward direction, passing into the curved descending exhaust space 273 which directs the flow outboard radially and upstream axially to a space 295 outboard of and parallel to the exhaust path from the lower section of the exhaust hood. The downward path may be in a same space or as space walled-off.

While various embodiments are described herein, it will be appreciated from the specification that various combinations of elements, variations or improvements therein may be made, and are within the scope of the invention.

The invention claimed is:

1. An exhaust arrangement for an axial flow steam turbine, the exhaust arrangement comprising:

an inner turbine casing including a plurality of turbine stages providing an axial steam flow path through the inner turbine casing and an exhaust outlet from a plurality of buckets of a last turbine stage;

a turbine condenser mounted below the steam turbine;

an exhaust hood at a downstream end of the steam turbine wherein the exhaust outlet flow through a diffuser into a dual path to the turbine condenser;

a bearing cone and a plurality of annular steam guides defining a diffuser flow path for the exhaust outlet flow;

a first exhaust path of the dual path through a lower section of the diffuser to a lower section of the exhaust hood and then essentially downward to the condenser;

an upper section of the exhaust hood in fluid communication with an upper section of the diffuser;

a radial channel of the exhaust hood in fluid communication with the upper section of the exhaust hood, wherein the radial channel is in fluid communication with the turbine condenser below; and a second exhaust path of the dual path through the upper section of the diffuser into the upper section of the exhaust hood, downstream axially to the radial channel and then downward through the radial channel to the turbine condenser.

2. The exhaust arrangement according to claim 1, the exhaust hood further comprising a divider wall between the upper section of the exhaust hood and the radial channel of the exhaust hood wherein a space is provided between an outer radius of the divider wall and an outer wall of the exhaust hood allowing for the second exhaust path between the upper section of the exhaust hood and the radial channel.

3. The exhaust arrangement according to claim 2, wherein the radial channel includes an upper exhaust space and two descending enclosed exhaust spaces to the turbine condenser, the exhaust spaces extending radially outboard from an outer wall of the exhaust hood.

4. The exhaust arrangement according to claim 2, wherein the radial channel includes an upper exhaust space and two descending exhaust spaces to the turbine condenser, the exhaust spaces being positioned axially downstream from the divider wall.

5. The exhaust arrangement according to claim 4, wherein the two descending exhaust spaces partially surround a rotor shaft extending through the exhaust hood.

6. The exhaust arrangement according to claim 5, wherein the two descending exhaust spaces of the radial channel are aligned in parallel.

7. The exhaust arrangement according to claim 6, wherein each of the two descending exhaust spaces of the radial channel includes an inner sidewall, wherein a opening space is provided there-between.

8. The exhaust arrangement according to claim 7, wherein the opening space is sufficiently large to allow personnel access to the bearing cone.

9. The exhaust arrangement according to claim 1, wherein the steam turbine is a dual axial flow steam turbine and the exhaust arrangement is provided at each end of the dual axial flow steam turbine.

10. The exhaust arrangement according to claim 1, wherein the exhaust hood structure begins at an axial end of the inner turbine casing and extends outward axially.

11. The exhaust arrangement according to claim 1, wherein the inner casing of the turbine is supported by directly to a foundation for the steam turbine.

12. The exhaust arrangement according to claim 1, wherein the means for directly supporting the inner turbine casing directly to a foundation includes at least one support arm on each side of the inner turbine casing extending to a foundation wall.

13. An axial flow steam turbine comprising:

an inner casing including a plurality of turbine stages providing an axial steam flow path through the inner casing and an exhaust outlet from a plurality of buckets of the last turbine stage;

a turbine condenser mounted below the steam turbine;

a foundation for the steam turbine;

an exhaust hood mounted to the an axial end of the inner casing and including a dual exhaust path from the turbine outlet to the turbine condenser including a radial channel downstream from a bearing cone; and support means for the steam turbine wherein the inner casing is supported directly from the foundation.

14. The steam turbine according to claim 13, wherein the support means for the inner turbine casing comprises at least one support arm from each lateral side of the inner turbine casing directly to a support wall of the foundation.

15. The steam turbine according to claim 13, the exhaust hood further comprising:

a diffuser space formed between the bearing cone and a plurality of steam flow guides, wherein a steam flow from the exhaust outlet of the inner casing passes through the diffuser space;

a first exhaust path to the turbine condenser through a lower section of the diffuser and a lower exhaust section of the exhaust hood; and a second exhaust path to the turbine condenser through an upper section of the diffuser, an upper exhaust section of the exhaust hood and the downstream radial channel.

16. The steam turbine according to claim 15, further comprising: a divider wall wherein the upper exhaust section of the exhaust hood is in fluid communication with the downstream radial channel of the exhaust hood through a space between an outer radius of the divider wall and an outer sidewall of the exhaust hood.

17. The steam turbine according to claim 16, wherein the radial channel comprises:

an upsteam section in fluid communication with the upper section of the exhaust hood: and at least one exhaust space on each lateral side of the rotor shaft, wherein the at least one exhaust space is in fluid communication with the turbine condenser below and is in fluid communication with the upsteam section of the radial channel above.

18. The steam turbine according to claim 17, wherein the at least one exhaust space on each lateral side of the rotor shaft includes a space allowing personnel access to the bearing cone.

19. The steam turbine according to claim 17, wherein the at least one exhaust space on each lateral side of the rotor shaft extends outboard and upstream from the upper section of radial channel of the exhaust casing.

20. The steam turbine according to claim 15 wherein the steam turbine comprises a dual axial flow steam turbine.

* * * * *